US005378213A

United States Patent [19]

Quint

[11] Patent Number: 5,378,213

[45] Date of Patent: Jan. 3, 1995

[54] AQUATIC TREADMILL WITH MESH BELT

[76] Inventor: Jeffrey T. Quint, 6641 Smith Rd., Cincinnati, Ohio 45140

[21] Appl. No.: 189,072

[22] Filed: Jan. 28, 1994

[51] Int. Cl.[6] ..... A63B 22/02

[52] U.S. Cl. ..... 482/54; 198/849

[58] Field of Search ..... 482/54, 51; 198/848, 198/849

[56] References Cited

U.S. PATENT DOCUMENTS

| | | | |
|---|---|---|---|
| 945,616 | 1/1910 | Schwartz | 198/849 |
| 2,117,957 | 5/1938 | Heller | 482/54 |
| 3,485,213 | 12/1969 | Scanlon . | |
| 3,659,845 | 5/1972 | Quinton . | |
| 3,689,066 | 9/1972 | Hagen . | |
| 3,703,284 | 11/1972 | Hesen . | |
| 3,711,090 | 1/1973 | Fideler . | |
| 3,737,163 | 6/1973 | Sumrall | 482/54 |
| 3,826,491 | 7/1974 | Elder . | |
| 4,227,487 | 10/1980 | Davis . | |
| 4,332,217 | 6/1982 | Davis . | |
| 4,445,683 | 5/1984 | Ogden . | |
| 4,544,152 | 10/1985 | Taitel . | |
| 4,548,405 | 10/1985 | Lee et al. . | |
| 4,576,376 | 3/1986 | Miller . | |
| 4,602,779 | 7/1986 | Ogden . | |
| 4,712,788 | 12/1987 | Gaudreau, Jr. . | |
| 4,776,581 | 10/1988 | Shepherdson . | |
| 4,872,664 | 10/1989 | Parker . | |
| 4,918,766 | 4/1990 | Leonaggeo, Jr. . | |
| 4,938,469 | 7/1990 | Crandell . | |
| 4,944,506 | 7/1990 | Keller et al. . | |
| 5,002,015 | 3/1991 | Sampson et al. . | |
| 5,018,722 | 5/1991 | Whitmore . | |
| 5,081,991 | 1/1992 | Chance . | |
| 5,108,088 | 4/1992 | Keller et al. . | |
| 5,123,641 | 6/1992 | Abboudi et al. . | |

OTHER PUBLICATIONS

Cambridge Conveyor Belts, 1941 p. 52.

Brochure: AquaCiser In—Pool Fitness Treatmill by AquaCiser, Inc. published by AquaCiser, Inc., Vail, Colo.

Brochure: Hydro-Tred—The First Portable "Drop In" Treadmill published by Hydro—Tred Mfg., Santa Fe, N. Mex.

Brochure: The Incredible Underwater Treadmill System! published by Ferno-Ille, Wilmington, Ohio.

*Primary Examiner*—Richard J. Apley
*Assistant Examiner*—Lynne A. Reichard
*Attorney, Agent, or Firm*—Wood, Herron & Evans

[57] ABSTRACT

A nonmotorized aquatic treadmill including an endless looped belt made from a meshed material to substantially reduce the friction between the meshed belt and the deck of the treadmill. In one embodiment, the treadmill includes fixed curved end pieces mounted at each end of the deck over which the meshed belt slides.

21 Claims, 2 Drawing Sheets

AQUATIC TREADMILL WITH MESH BELT

BACKGROUND OF THE INVENTION

1. Field of the Invention

The invention relates to exercise devices and more particularly to a nonmotorized treadmill located in a tank of fluid which utilizes fluid resistance in exercising.

2. Description Of the Related Art

Aquatic exercise devices are well known, and a typical nonmotorized aquatic treadmill is shown in U.S. Pat. No. 4,576,376 issued to P. F. Miller on Mar. 14, 1986. The '376 patent discloses a solid endless belt looped around two rollers which are separated by a flat plate over which the belt slides in response to a walking action by a user. Nonmotorized treadmills are difficult to use because of the relatively high coefficient of friction between the bottom surface of the upper flight of the belt and the top surface of the flat plate in combination with the vertical force exerted by the weight of the user over the area of the user's feet. Further, the user creates varying horizontal forces during a striding motion which cause the user varying degrees of difficulty in pushing the treadmill belt smoothly over the plate. For example, at the beginning of a stride, when the user's front foot is planted and the rear foot leaves the surface, it is difficult for the user to create a horizontal force that is effective to push the belt over the plate toward the rear of the treadmill. Therefore, the nonmotorized treadmill is difficult to use at that point in the user's stride. As the stride progresses and the user's foot contacting the belt moves under and behind the user, a greater horizontal force component is exerted by the user on the belt; and the belt is more easily slidingly moved over the plate. Consequently, as the user moves from the initial portion of the stride toward the end of the stride, the degree of difficulty of moving the belt with respect to the plate changes from the most difficult to least difficult; and therefore, a smooth, consistent striding action and treadmill motion is not easily maintained.

The problem of reducing friction between the belt and the plate is addressed in the '376 patent by providing a perforated plate or providing a plate with a low friction upper surface or both. Friction may also be reduced by using a laminated belt as disclosed in U.S. Pat. No. 3,711,090 issued to V. G. Fiedler on Jan. 16, 1973. In the '090 patent, a belt is a laminated member which has an outer layer of conventional material which is comfortable to the user and has a adjoining laminated inner layer made of sheet material such as nylon, teflon, orlon, or other plastics having low friction coefficient characteristics. Further, low friction surfaces may also be used both on the top surface of the deck and the lower surface of the belt.

While the above treadmill constructions reduce the co-efficient of friction between the deck plate and the belt, there still is a substantial frictional force associated therewith.

SUMMARY OF THE INVENTION

To overcome the disadvantage described above and to provide a better aquatic exercise device, the present invention provides an aquatic treadmill which is easy to use, has a smooth consistent action, has the simplest possible construction with a minimum of parts, and is therefore, more reliable and less expensive.

According to the principles of the present invention and in accordance with the described embodiments, an aquatic nonmotorized treadmill includes a weight bearing member having a smooth, upper surface supported in tank containing a liquid. An endless looped having a mesh pattern belt is mounted on the weight bearing member for sliding contact with the upper surface thereof. The meshed belt is made from a low friction material and has the advantage of providing very little friction between the belt and the upper surface of the weight bearing member.

The friction is so reduced that, in another embodiment, the treadmill includes two fixed curved surfaces adjacent the ends of the weight bearing member and around which the meshed belt extends. The fixed curved surfaces are used instead of end rollers and therefore, have the advantage of providing a more reliable operation with a less expensive construction.

In a further embodiment, the weight bearing member is supported above the bottom of the tank by two side rails connected to the weight bearing member. Each of the side rails includes at least one projection which extends away from the weight bearing member a distance in excess of a path of travel of the meshed belt. Consequently, the belt is captured between the projections, and the projections function to hold the belt on the weight bearing member.

In a still further embodiment, the treadmill includes two rollers rotatably mounted to and extending between the side rails. The meshed belt is made from a low resistance material such as a high density thermoplastic or a thermoset polymer.

These and other objects and advantages of the present invention will become more readily apparent during the following detailed description together with the drawings herein.

DETAILED DESCRIPTION OF THE INVENTION

Figure 1:
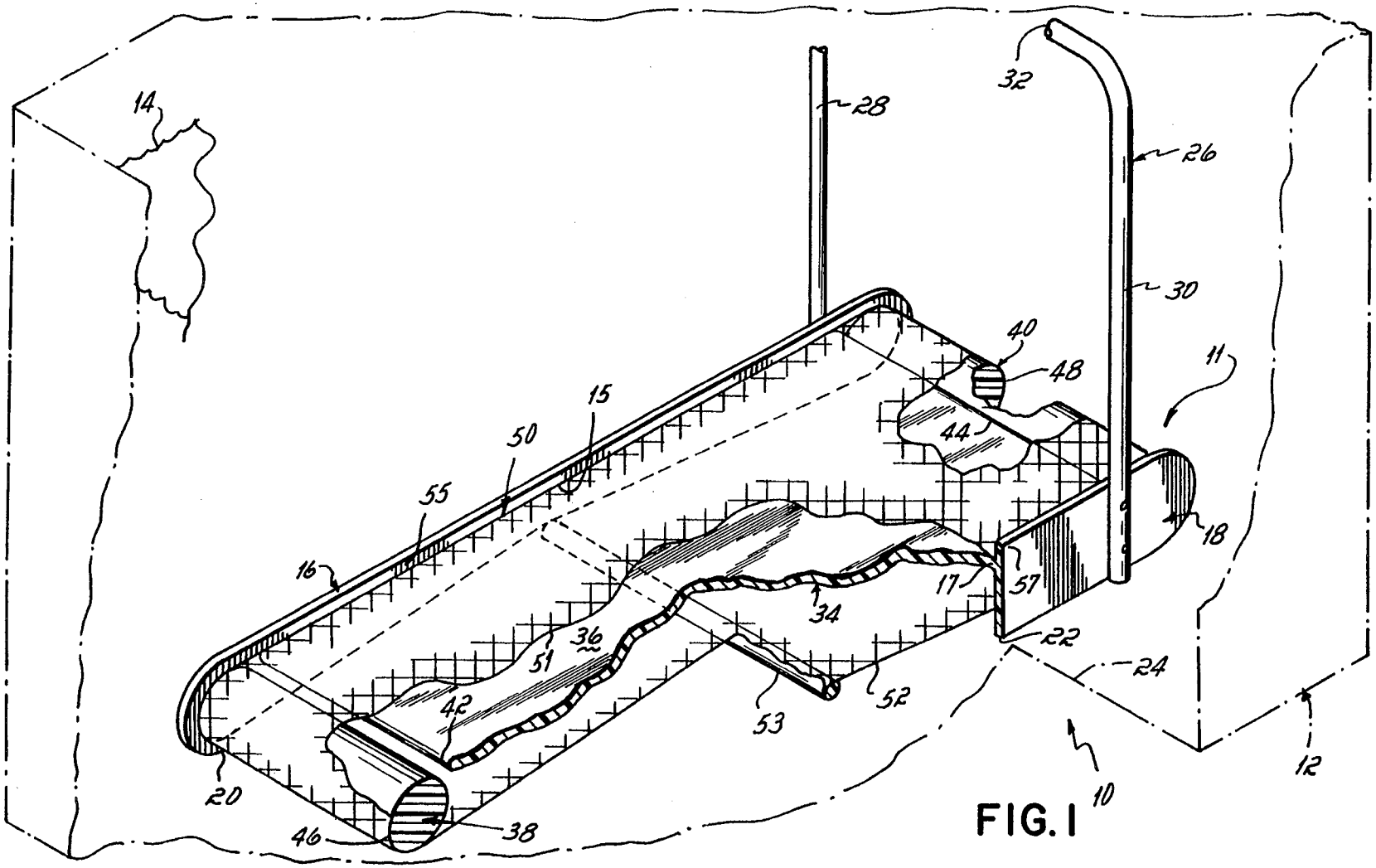
FIG. 1 is a perspective view of the invention with a cut away section to illustrate a first embodiment in which the treadmill belt slides over curved fixed end pieces.

Referring to FIG. 1, the aquatic treadmill system 10 of the present invention includes a nonmotorized treadmill 11 located in a tank 12 shown in phantom filled with a fluid 14. The treadmill 11 has two side rails 16 and 18 which have bottom edges 20 and 22, respectfully, that are in contact with and rest on the bottom 24 of the tank 12. A support handle 26 is comprised of two vertical members 28 and 30 having a lower end rigidly connected to the rails 16 and 18, respectively. A cross bar 32 has its ends connected to the upper ends of the vertical members 28, 30. A deck 34 which bears the weight of the user is rigidly connected along its sides 15, 17 to and between the rails 16, 18. The deck 34 is generally horizontal and has a flat, smooth upper surface 36.

First and second nonrotating curved end pieces 38, 40 are located at the first and second ends 42, 44, respectively, of the deck 34 and are rigidly connected to and extend between the rails 16, 18. The end pieces 38, 40 are located such that their outer curved surfaces 46, 48 tangentially intersect a plane which is common with the upper surface 36 of the deck 34. The curved surfaces extend through an arc in the range of from approximately 90° to approximately 360°. Preferably the arc of the curved surface is at least 180°.

The treadmill 11 includes an endless looped meshed belt 50 which is mounted on the deck 34 and first and second end pieces 38, 40. The belt has an upper flight 51 which slides over the upper surface 36 of the deck 34 in response to the striding or walking action of the user. The meshed construction of the belt minimizes the surface area of the belt in contact with the upper surface 36, Therefore, there is a significantly less frictional force between the meshed belt 50 and the upper surface 36 than exists with a solid belt. To further reduce friction, the belt is made from a high molecular weight plastic material. The endless meshed belt has a meshed pattern that is in the range of approximately 0.04 square inches to approximately one square inch. The preferred mesh has a mesh pattern of approximately 0.36 square inches. The mesh fiber has a size that ranges from approximately 0.01 inches in diameter to approximately 0.25 inches in diameter; and preferably the mesh fiber is 0.035 inches in diameter.

As the belt 50 moves over the deck 34 and around and underneath the first end piece 38 to the second end piece 40, a lower flight 52 of the belt will tend to droop and may touch and may drag along the bottom 24 of the tank 12. If the belt 50 does contact the bottom 24 of the tank 12, the belt will be subject to additional wear; and there will be an increase frictional force associated with operating the belt. Therefore, a cross member 53 is connected to and extends between the sides 16 and 18 and is located such that the lower flight 52 of the belt 50 is located above the cross member 53. Therefore, the lower flight 52 is held up above the bottom 24 of the tank 12.

In use, the tank 12 is filled with water to a level that is comfortable for the user. The buoyancy of the user in the water reduces the vertical force being exerted on the belt 50 thereby reducing the frictional force between the belt 50 and the top surface 36 of the deck 34. Consequently, as the user begins a walking, or striding motion, the user will apply a force to the belt 50 that has a horizontal component that is effective to move the belt 50 in a sliding motion over the upper surface 36 of deck 34 in a direction moving from the second end of the deck 44 toward the first end of the deck 42. The minimal frictional forces result because the belt is made from a meshed material which permits a more consistent stride with less effort. The deck 34 has an upper surface made from a hard dense material which is both smooth and resistant to the corrosive effects of sanitation chemicals added to the fluid in which the treadmill is contained. Such materials may be any high density plastic material, a polished stainless steel sheet or any noncorrosive alloy. Further, the reduced friction permits the use of nonrotating, fixed end pieces 38, 40. As the user continues to walk the endless, meshed belt moves continuously around the deck 34 and the end pieces 38, 40. Forces created by the user or minor misalignments in the construction of the treadmill may cause the belt to track, that is, move, toward one or the other of the side rails 16, 18. Many treadmills contain adjustments that control the parallelism of the endpieces 16, 18; however, in the embodiment of FIG. 1, the endless, meshed belt 50 is maintained on the deck 34 by projections 55, 57 of the rails 16, 18, respectively, above and below the deck 34. The projections of the rails 16, 18 extend beyond the path of the moving belt, thereby capturing the belt 50 therebetween and maintaining the belt in a desired track on the upper surface 36 of the deck 34.

Figure 2:
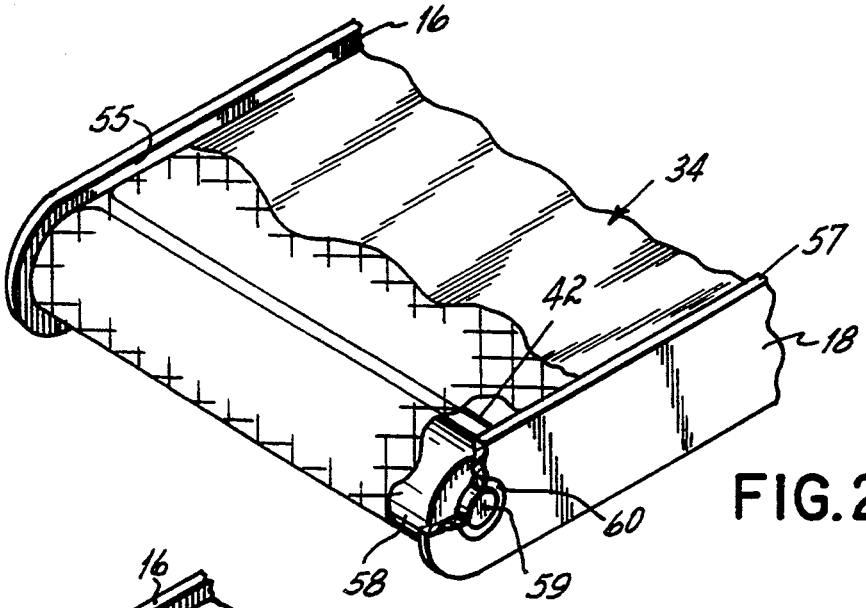
FIG. 2 is a partial cut away perspective view illustrating a second embodiment in which the treadmill belt slides over end rollers.

Referring to FIG. 2 an alternative embodiment of the invention is shown, in which the fixed end pieces are replaced by rollers. A roller 58 is rotatably mounted to and extends between the rails 16, 18. Each end of the roller 58 has an axle 59 rotatably mounted in a bearing 60 which is mounted in a side rail, for example, side rail 18.

Figure 3:
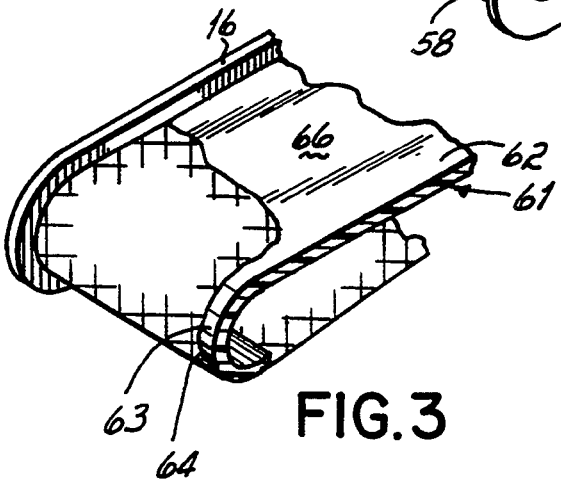
FIG. 3 is a partial cut away perspective view illustrating the treadmill belt sliding over a deck incorporating curved fixed ends.

FIG. 3 illustrates a further embodiment of the invention in which the deck and end pieces are manufactured as a single piece. Referring to FIG. 3, a deck 61 has a first horizontal flat section 62, each end of which is connected to and contiguous with a curved section 63. As previously described with regard to the end pieces 38, 40, each of the curved sections 63 has an outer surface 64 which tangentially intersects a plane passing through the upper surface 66 of the horizontal section 62. The curved section 63 extends through an arc in the range of approximately 90° to approximately 360°. Preferably, the arc of the curved section 63 is approximately 180°.

Figure 4:
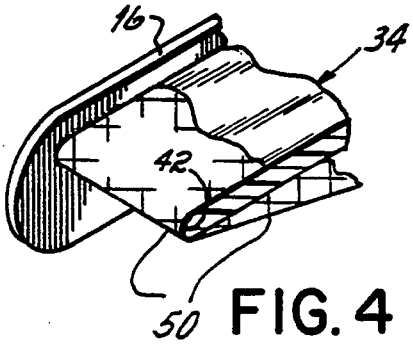
FIG. 4 is a partial perspective cut away to illustrate a fourth embodiment of the invention in which the treadmill belt slides over the supporting deck with no end guides.

FIG. 4 illustrates a further embodiment of the invention in which the endless meshed belt 50 extends over the fixed ends, for example, end 42, of the upper deck 34 in the absence of any rollers or end pieces. In this embodiment, the ends of the deck 34 each have a curved shape, preferably, a curved surface forming an arc of 180°.

While the invention has been set forth by a description of the embodiment in considerable detail, it is not intended to restrict or in any way limit the claims to such detail. Additional advantages and modifications will readily appear to those that are skilled in the art. For example, the meshed belt may be made from delrin, nylon, high density polyethylene, other high density thermoplastics or thermoset polymers, composite reinforced plastic, thermal plastic elastomers, interlocking metal links in a meshed pattern, or other materials that are manufactured with a mesh pattern with a smooth surface that provide reasonably little friction between the meshed belt and the upper surface of the deck.

The illustrated embodiments show either fixed or rotating endpieces 38, 40 at both ends 42, 44 of the deck 34. Alternatively, a rotating end piece may be used at one end of the deck, and a fixed nonrotating end piece may be used at the other end of the deck. The fixed nonrotating piece may be a separate cylinder, curved end section or simply an end of the deck itself. In addition, the cross member 53 may be eliminated if the rails 16, 18 have a sufficient height to support the deck 34 a distance above the bottom 24 of the tank 12 so that the lower flight 52 of the belt 50 does not drag on the bottom surface 24. The illustrated embodiments show upper and lower projections of the rails 16, 18 as functioning to capture the belt 50 therebetween to maintain the belt in the desired track on the deck 34. The projections extend around the full path of the belt. Alternatively, the projections may extend only partially around the path of the belt. Further, the projections on the rails 16 18 to not necessarily have to be opposite each other. In addition, other known mechanisms may be used to maintain the belt 50 on its desired track on the deck 34.

It will also be appreciated that except for the belt 50, the treadmill 11 may be made as a single molded component or any combination of pieces that provide the necessary support and that are preferable for handling and packaging. The side rails 16, 18, the deck 34 and end pieces 38, 40 may be made from wood, metal, plastic, or any other material which is suitable for use in water and will support the weight of the user; and those parts may be connected with fasteners, adhesives, welding or other known processes for joining such parts. The handle 26 may similarly be made from any wood, metal, or plastic material that is suitable for use under water and that provides the necessary strength and rigidity that facilitates its use as a support for the user.

The invention therefore in its broadest aspects is not limited to the specific details shown and described. Accordingly, departures may be made from such details without departing from the spirit and scope of the invention.

What is claimed is:

1. An aquatic treadmill comprising:

a tank combining a liquid;

a weight bearing member supported within the tank, the weight bearing member having an upper surface in the liquid; and belt means mounted on the weight bearing member for moving in sliding contact with the upper surface of the weight bearing member in the liquid in response to forces generated by a user in the liquid, the belt means comprising an endless, looped belt having a mesh construction for reducing friction between the belt means and the upper surface of the weight bearing member, thereby permitting the user to move the belt means with less effort.

2. The aquatic treadmill of claim 1 wherein the weight bearing member is generally rectangular with two opposing sides extending generally longitudinally over a length of the weight bearing member and two opposing ends generally perpendicular to the sides and extending generally across a width of the weight bearing member.

3. The aquatic treadmill of claim 2 further comprising at least one nonrotating fixed curved surface having a first end adjacent one end of the weight bearing member, and the belt means extending over the upper surface of the weight bearing member and over the nonrotating fixed curved surface.

4. The aquatic treadmill of claim 2 further comprising two nonrotating fixed curved surfaces, each of the nonrotating fixed curved surfaces having a first end adjacent one of the two opposing ends of the weight bearing member, and the belt means extending over the upper surface of the weight bearing member and over the two nonrotating fixed curved surfaces.

5. The aquatic treadmill of claim 4 wherein the two fixed curved surfaces extend through an arc in the range of from approximately 90° to approximately 360°.

6. The aquatic treadmill of claim 4 wherein each of the two nonrotating fixed curved surfaces extend through an arc of approximately 180°.

7. The aquatic treadmill of claim 2 further comprising two rails connected to and extending along the sides of the weight bearing member to support the weight bearing member a predetermined distance above a bottom of the tank.

8. The aquatic treadmill of claim 7 wherein each of the two rails comprising a projection extending generally outwardly from the weight bearing member past the belt means, wherein the projections on the two rails maintain the belt means on the upper surface of the weight bearing member between the two rails.

9. The aquatic treadmill of claim 8 wherein the projections are located on the rails in opposition to each other.

10. The aquatic treadmill of claim 9 wherein the projections extend along sides of the weight bearing member and have a height extending in a generally vertical direction above and below the weight bearing member a distance in excess of a path of travel of the belt means wherein the two rails maintain the belt means on the upper surface of the weight bearing member between the two rails.

11. The aquatic treadmill of claim 7 further comprising at least one roller rotatable mounted between the two rails adjacent one end of the weight bearing member, the belt means extending over the upper surface of the weight bearing member and an outer surface of the roller.

12. The aquatic treadmill of claim 7 further comprising a pair of rollers rotatable mounted between the two rails adjacent the ends of the weight bearing member, the belt means extending over the upper surface of the weight bearing member and the pair of rollers.

13. The aquatic treadmill of claim 7 further comprising two fixed curved surfaces mounted between the two rails, each of the fixed curved surfaces having a first end adjacent one of the two opposing ends of the weight bearing member, and the belt means extending over the upper surface of the weight bearing member and the two fixed curved surfaces,

14. The aquatic treadmill of claim 1 wherein the belt means is made of a high density thermoplastic.

15. The aquatic treadmill of claim 1 wherein the belt means is made of a thermoset polymer.

16. The aquatic treadmill of claim 1 wherein the belt means has a mesh pattern wherein each opening in the mesh pattern is in the range of from approximately 0.04 square inches to approximately 1 square inch.

17. The aquatic treadmill of claim 1 wherein the belt means has a mesh pattern wherein each opening in the mesh pattern is approximately 0.36 square inches.

18. An aquatic treadmill for use in a tank filled with a liquid comprising:

a weight bearing member adapted to be supported within a tank, the weight bearing member having an upper surface in the liquid and a predetermined distance above a bottom of the tank; and belt means mounted on the weight bearing member for moving in sliding contact with the upper surface of the weight bearing member in the liquid in response to forces generated by a user in the liquid, the belt means comprising an endless, looped belt of a mesh construction for reducing friction between the belt means and the upper surface of the weight bearing member, thereby permitting the user to move the belt means with less effort.

19. An aquatic treadmill for use in a tank filled with liquid comprising:

a weight bearing member adapted to be located in the liquid within a tank, the weight bearing member having two ends;

a generally smooth upper surface between the two ends a predetermined distance above a bottom of the tank, and two fixed curved surfaces, each of the two fixed curved surfaces having a first end connected to and contiguous with one end of the generally smooth upper surface, each of the two fixed curved surfaces extending from the first end through an arc of approximately 180 degrees; and belt means mounted on the weight bearing member for moving in sliding contact with the generally smooth upper surface and the two fixed curved surfaces of the weight bearing member in response to forces generated by a user in the liquid, the belt means comprising an endless, looped belt constructed in a mesh pattern for reducing friction between the belt means and the upper surface of the weight bearing member, thereby permitting the user to move the belt means with less effort.

20. An aquatic treadmill for use in a tank filled with a fluid comprising:

weight bearing member located in the liquid within a tank, the weight bearing member having two longitudinally extending sides and two ends;

a generally smooth upper surface between the two ends, a pair of rails connected to the two longitudinally extending sides, and two fixed curved surfaces mounted between the pair of rails, each of the two fixed curved surfaces having a first end approximately contiguous with one end of the generally smooth upper surface, each of the two fixed curved surfaces extending from the first end through an arc of approximately 180 degrees; and belt means mounted on the weight bearing member for moving in sliding contact with the generally smooth upper surface and the two fixed curved surfaces in response to forces generated by a user in the liquid, the belt means comprising an endless, looped belt of a meshed construction for reducing friction between the belt means and the upper surface of the weight bearing member, thereby permitting the user to move the belt means with less effort.

21. An aquatic treadmill for use in a tank filled With a liquid comprising:

weight bearing member located in the liquid within a tank, the weight bearing member having two longitudinally extending sides and two ends;

a generally smooth upper surface between the two ends, a pair of rails connected to the two longitudinally extending sides, and a pair of rollers rotatable mounted between the pair of rails, each of the pair of rollers having an outer cylindrical surface adjacent to and contiguous with one end of the generally smooth upper surface; and belt means mounted on the weight bearing member for moving in sliding contact with the generally smooth upper surface and the outer cylindrical surface of each of the pair of rollers in response to forces generated by a user in the liquid, the belt means comprising an endless, looped belt of a mesh pattern construction for reducing friction between the belt means and the upper surface of the weight bearing member, thereby permitting the user to move the belt means with less effort.

* * * * *